US008088712B2

(12) United States Patent
Shimbo et al.

(10) Patent No.: US 8,088,712 B2
(45) Date of Patent: Jan. 3, 2012

(54) REVERSIBLE THERMOSENSITIVE RECORDING MEDIUM, REVERSIBLE THERMOSENSITIVE RECORDING LABEL, MEMBER, AND IMAGE PROCESSING METHOD

(75) Inventors: Hitoshi Shimbo, Shizuoka (JP); Kunio Hayakawa, Mishima (JP); Jun Maruyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 813 days.

(21) Appl. No.: 12/190,078

(22) Filed: Aug. 12, 2008

(65) Prior Publication Data

US 2009/0048106 A1 Feb. 19, 2009

(30) Foreign Application Priority Data

Aug. 13, 2007 (JP) ..... 2007-210832

(51) Int. Cl.
*B41M 5/333* (2006.01)
*B41M 5/337* (2006.01)

(52) U.S. Cl. ..... 503/201; 503/214; 503/216

(58) Field of Classification Search ..... None
See application file for complete search history.

(56) References Cited

U.S. PATENT DOCUMENTS 7,338,919 B2 3/2008 Kawahara et al.
2007/0219093 A1 9/2007 Shimbo et al.

FOREIGN PATENT DOCUMENTS

CN 101003499 A 7/2007
EP 1834799 A1 9/2007
JP 6-199041 7/1994
(Continued)

OTHER PUBLICATIONS

Oct. 16, 2008 search report in connection with a counterpart European patent application No. 08 16 2247.

(Continued)

*Primary Examiner* — Bruce H Hess
(74) *Attorney, Agent, or Firm* — Cooper & Dunham LLP

(57) ABSTRACT

The present invention provides a reversible thermosensitive recording medium including:

a support, and a reversible thermosensitive recording layer laid on the support, the recording layer containing a reversible thermosensitive composition, wherein the reversible thermosensitive composition forms a relatively color-developed state and a colorless state depending on a difference in a heating temperature and/or a cooling rate after heating by the use of an electron-donating color-forming compound and an electron-accepting compound; a resin component contained in the reversible thermosensitive recording layer is a resin in which a polyol resin having a hydroxyl value within the range of 100 KOHmg/g to 250 KOHmg/g is crosslinked; and as the electron-accepting compound, a urea compound represented by the following General Formula (1) is used, General Formula (1)

where "n" is an integer of 23 or greater.

6 Claims, 2 Drawing Sheets

FOREIGN PATENT DOCUMENTS

| | | |
|---|---|---|
| JP | 7-164648 | 6/1995 |
| JP | 8-45038 | 2/1996 |
| JP | 9-267568 | 10/1997 |
| JP | 10-230680 | 9/1998 |
| JP | 11-240251 | 9/1999 |
| JP | 2981558 | 9/1999 |
| JP | 2000-25336 | 1/2000 |
| JP | 2002-166649 | 6/2002 |
| JP | 2005-53124 | 3/2005 |
| JP | 3734346 | 10/2005 |
| JP | 3760431 | 1/2006 |
| JP | 2006-290874 | 10/2006 |
| JP | 4024474 | 10/2007 |
| WO | WO2006/098507 A1 | 9/2006 |

OTHER PUBLICATIONS

Nov. 13, 2009 Chinese official action (with English translation) in connection with a counterpart Chinese patent application No. 200810146146.1.

REVERSIBLE THERMOSENSITIVE RECORDING MEDIUM, REVERSIBLE THERMOSENSITIVE RECORDING LABEL, MEMBER, AND IMAGE PROCESSING METHOD

BACKGROUND OF THE INVENTION

1. Field of the Invention

The present invention relates to a reversible thermosensitive recording medium that allows for forming a color-developed image and erasing the formed image by controlling thermal energy with the use of a reversible thermosensitive color-developing composition utilizing color-developing reactions between an electron-donating color-forming compound and an electron-accepting compound, relates also a reversible thermosensitive recording label, a member, and an image processing method.

2. Description of the Related Art

Thermosensitive recording compounds utilizing color-developing reactions between electron-donating color-forming compounds (hereinafter otherwise referred to as "color formers" or "leuco dyes") and electron-accepting compounds (hereinafter otherwise referred to as "developers") are widely known, and they are widely used as output paper for facsimiles, word processors, scientific measurement devices, etc. along with the development of office automation and also as magnetic thermosensitive cards such as prepaid cards and discount cards. In particular, developments on reversible thermosensitive recording media that allow information and or images to be rewritten any number of times are desired in view of ecological problems and recycling. In Japanese Patent (JP-B) No. 2,981,558, the present inventors proposed a reversible thermosensitive color-developing composition in which an organic phosphoric acid compound having a long-chain aliphatic hydrocarbon group, and an aliphatic carboxylic acid compound or a phenol compound is used as a developer, and a leuco dye serving as a color former is combined therewith; and a reversible thermosensitive recording material using the reversible thermosensitive color-developing composition as a recording layer. This reversible thermosensitive recording material makes it possible to carry out color development and color erasure easily based upon adjustment of heating conditions, sustain the color-developed state and the colorless state stably at normal temperature and repeat color development and color erasure:

As the number of repeatedly rewriting times is increased, the frequency causing reductions in color-developed density is increased due to sedimentation of foreign matters adhering to heat sources such as thermal heads, and ceramic heaters. Further, the amount of energy applied to such heat sources is increased as the conveyance speed of printer is increased, and thus the adhesion amount of foreign matters tends to increase. This causes print defects (a reduction of color-developed density, faded images, ink voids, etc.) and poses a substantial impediment to innovation activities of obtaining high-speed performance of printers.

In order to solve the problem caused at the time of repetitive printing, various examinations have been made so far. For instance, as a method of preventing foreign matters from adhering to thermal head(s), Japanese Patent Application Laid-Open (JP-A) Nos. 2000-25336 and 11-240251 respectively propose a method of providing a protective layer composed of an electron beam curable resin and a filler. This method poses a barrier against thermal propagation from a thermal head to a reversible thermosensitive recording layer, and a reduction in color-developing/color erasure sensitivity is caused, and thus this method cannot be said as efficient. In particular, when the conveyance speed of printer is increased high, the above-mentioned problem is further encouraged. As other methods, Japanese Patent Application Laid-Open (JP-A) No. 2005-53124 proposes a method of utilizing a silicon resin in a protective layer; Japanese Patent Application Laid-Open (JP-A) No. 2002-166649 proposes a method of setting the surface roughness of a protective layer to a specific condition; and Japanese Patent Application Laid-Open (JP-A) No. 9-267568 proposes a method of forming a barrier layer containing an organic material. However, these methods have a problem to cause a degradation of color-developing/color erasure sensitivity, and thus they cannot be said as efficient.

Meanwhile, besides the above-mentioned methods, Japanese Patent Application Laid-Open (JP-A) No. 10-230680 and Japanese Patent (JP-B) No. 3734346 respectively propose making a crosslinked resin for recording layer to thereby increase the strength of the recording layer. However, the function of color-developing/color erasure is yet insufficient by the use of only this method. Further, it is unfavorable because a sufficient color-developed density cannot be obtained, which collaterally affects other properties, for example, storage stability.

Further, as methods of preventing the occurrence of print defects by using a member(s) other than recording media, Japanese Patent Application Laid-Open (JP-A) Nos. 8-45038 and 7-164648 respectively propose a method of removing foreign matters adhering on a thermal head by using a cleaning member; and Japanese Patent Application Laid-Open (JP-A) No. 6-199041 proposes a method of applying a liquid onto a thermal head. Although these methods achieve an object for solving the problems, they are based upon a process different from the color-developing/color erasure process for reversible thermosensitive recording media, and have shortcomings that it takes extra effort and the workability becomes poor, and thus it cannot be said that they can fundamentally solve the problem.

Under such circumstances, it is desired to propose a reversible thermosensitive recording material that causes less adhesion of foreign matters, allows for fast conveyance and is excellent in erasure property in a condition being conveyed fast.

BRIEF SUMMARY OF THE INVENTION

An object of the present invention is to provide a reversible thermosensitive recording medium that causes less adhesion of foreign matters to heat sources such as thermal head, allows for fast conveyance and is and is excellent in erasure property in a condition being conveyed fast.

As a result of carrying out various examinations to find a method of simultaneously improving both removability of adhered foreign matters and erasure property, the present inventors found that it is possible to achieve a level where both removability of adhered foreign matters and erasure property can be satisfactorily obtained by the use of a crosslinked polyol resin having a high hydroxyl value as a resin component contained in a reversible thermosensitive recording layer, and further by the use of a urea derivative having an alkyl group containing 23 or more carbon atoms and a phenol group. The findings lead to the present invention.

The means for solving the aforesaid problems are as follows:

<1> A reversible thermosensitive recording medium including:

a support, and a reversible thermosensitive recording layer laid on the support, the recording layer containing a reversible thermosensitive composition, wherein the reversible thermosensitive composition forms a relatively color-developed state and a colorless state depending on a difference in a heating temperature and/or a cooling rate after heating by the use of an electron-donating color-forming compound and an electron-accepting compound; a resin component contained in the reversible thermosensitive recording layer is a resin in which a polyol resin having a hydroxyl value within the range of 100 KOHmg/g to 250 KOHmg/g is crosslinked; and as the electron-accepting compound, a urea compound represented by the following General Formula (1) is used, General Formula (1)

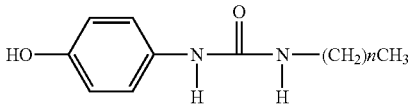

where "n" is an integer of 23 or greater.

<2> A reversible thermosensitive recording label including:

the reversible thermosensitive recording medium according to the item <1>, and an adhesive layer (tacky layer) provided on a surface of a support of the reversible thermosensitive recording medium, which is opposed to a surface on which the reversible thermosensitive recording layer is provided.

<3> A member having an information recording section, including:

an information storage section, and a reversible display section, wherein the reversible display section includes at least the reversible thermosensitive recording medium according to the item <1>.

<4> A member having an information recording section, including:

an information storage section, and a reversible display section, wherein the reversible display section includes at least the reversible thermosensitive recording label according to the item <2>.

<5> The member according to any one of the items <3> and <4>, being any one of a card, a disc, a disk cartridge, and a tape cassette.

<6> An image processing method including:

forming an image, and/or erasing the formed image by heating any one of reversible thermosensitive recording layers each of which constitutes any one of the reversible thermosensitive recording medium according to the item <1>, the reversible thermosensitive recording label according to the item <2>, and the member having an information storage section according to any one of the items <3> to <5>.

<7> The image processing method according to the item <6>, wherein the image is formed using a thermal head.

<8> The image processing method according to the item <6>, wherein the formed image is erased using any one of a thermal head and a ceramic heater.

A reversible thermosensitive recording medium of the present invention can exhibit extremely excellent effects that the recording medium is excellent in image fastness properties, erasure property and repetitive durability even during high-speed printing.

DETAILED DESCRIPTION OF THE INVENTION

Hereinafter, a reversible thermosensitive recording medium of the present invention will be described in detail.

A reversible thermosensitive recording medium of the present invention, which uses a phenol compound, can form a relatively color-developed state and a colorless state depending on a difference in a heating temperature and/or a cooling rate after heating.

The essential color developing and erasing phenomenon will be described below.

Figure 1:
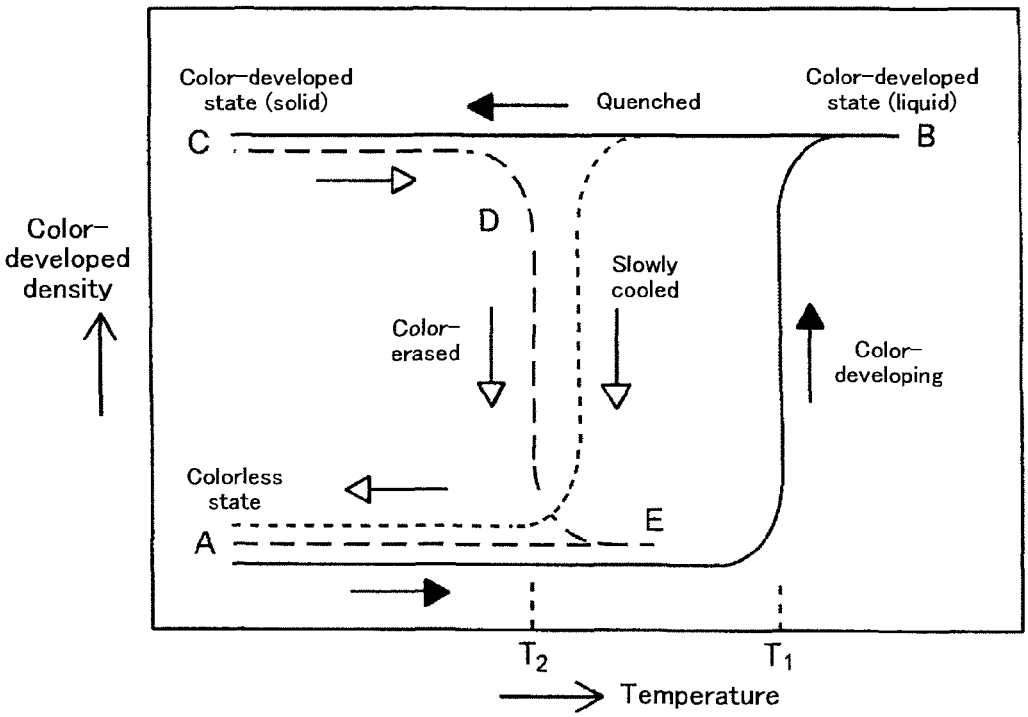
FIG. 1 is a view explaining color-developing/color erasure properties of a reversible thermosensitive color-developing composition of the present invention.

Here, FIG. 1 shows the relation between a color-developed density and a temperature in the reversible thermosensitive recording medium. When the recording medium is heated from an initial colorless state (A), a leuco dye and a developer are melted at a temperature T1 at which the melting begins, and then the recording medium becomes in a melted and developed state (B), through an occurrence of color developing. When quenched from the melted and developed state (B), the recording medium can be cooled to the room temperature while maintaining the developed state (B), thereby a fixed and developed state (C) emerges. Whether or not the developed state emerges depends on the cooling rate from the melted state, and when cooled slowly, the color erasure appears during a temperature decreasing process, that is, the initial colorless state (A) or a state of lower density than in the quenched color-developing state (C) emerges. On the other hand, when heated again from the quenched color-developing state (C), color erasure occurs at a lower temperature T2 than a developing temperature (D to E); when cooled from this temperature, resulting in the initial colorless state (A). Actual developing temperature and erasing temperature may be selected depending on the intended use since these temperatures vary with the coloring agent and color developer used. Further, the color-developed density at the melting state and the color-developed density after the quenching may not necessarily coincide, and may different from each other in some cases.

In the reversible thermosensitive recording medium of the invention, the color-developing state (C) obtained through quenching from the melted state is a state in which the developer and a color former are blended such that they may react through inter-molecular contact, and the state is often in a solid state. In the state, the developer and color former are coagulated to represent a color-developing state. It is believed that the formation of the coagulated state makes the color-developing state stable. On the other hand, in the erased state, the developer and color former are in phase separation. It is believed that the molecules of at least one of the compounds assemble to form domains or crystals in the separated state, and that the developer and color former are separated and stabilized through the coagulation or crystallization. In the present invention, in many cases, the phase separation between the developer and the color former and the crystallization of the developer cause substantially perfect erasure. In the color-erased state induced by slowly cooling the recording medium from the melted state as well as the color-erased state induced by heating the recording medium from the color-developed state as shown in FIG. 1, the coagulated structures are altered depending on the temperatures, resulting in the phase separation between the developer and the color former and/or crystallization of the developer.

The present inventors deemed that in order to erase a color-developed image in an extremely short period of time as seen in the case of heating of a thermal head, the crystallization rate or the quickness of crystallization of a developer used when heating a recording medium from the temperature of the developed state (C) to a color-erased temperature (T2) is important, and made various examinations.

As a result, the inventors found that a urea compound represented by General Formula (1) is particularly superior in erasure property.

General Formula (1)

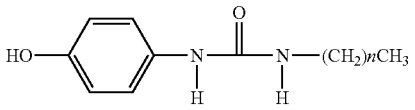

In General Formula (1), "n" is an integer of 23 or greater.

Urea-based phenol compounds having a structure represented by General Formula (1) is proposed in Japanese Patent (JP-B) No. 3328077, which describes that the more preferable the greater the value of "n" is, but, when the value of "n" is 22 or greater, it is unfavorable to use it in terms of production cost. However, JP-B No. 3328077 does not specifically describes how synthesize, purify and identify a compound containing a long chain alkyl group with "n" value of 22 or greater, nor does it describe an experimentally confirmed fact that a reversible thermosensitive recording material having what-like properties was produced by using the compound produced. Therefore, it is uncertain what the reason for the description, i.e., why it is unfavorable to use it in terms of production cost. However, it was not actually easy to synthesize a compound containing a long chain alkyl group with the value "n" of 22 or greater. The inventors strenuously attempted to synthesize such a compound containing a long chain alkyl group with a value "n" of 22 or greater. As a result of the evaluation, the inventors found that with the use of a compound containing a long chain alkyl group with a value "n" of 22 or greater, in particular, with the use of a compound containing a long chain alkyl group with a value "n" of 27 or greater, the erasure property and image fastness properties of the recording medium are dramatically improved. Further, the inventors found that a more preferable range of value "n" is from 27 to 32.

In addition to developers of the present invention, any of electron-accepting phenol compounds used in various conventionally known reversible thermosensitive recording media can be mixed with the above-noted compound.

Leuco dyes used in the present invention may be used alone or in combination in the form of a mixture. Examples thereof include phthalide compounds, azaphthalide compounds, and fluoran compounds, which are conventionally known precursors of dyes. Specific examples of leuco dyes used in the present invention are as follows:

2-anilino-3-methyl-6-diethylaminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran, 2-bromo-6-diethylaminofluoran,
2-chloro-6-dipropylaminofluoran, 3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide, 3-(1-methyl-2-methylindole-3-yl)-3-(2-hexyloxy-4-diethylaminophenyl)-4-azaphthalide, 3,3-bis(2-ethoxy-4-diethylaminophenyl)-4-azaphthalide and 3,3-bis(2-ethoxy-4-diethylaminophenyl)-7-azaphthalide.

In particular, by using at least one selected from 2-anilino-3-methyl-6-diethylaminofluoran, 2-anilino-3-methyl-6-di(n-butylamino)fluoran, 2-anilino-3-methyl-6-(N-n-amyl-N-ethylamino)fluoran, 2-(3-toluidino)-3-methyl-6-diethylaminofluoran, and 2-xylidino-3-methyl-6-dibutylaminofluoran as leuco dye(s), it is possible to obtain print images whose color-developed density, erasure property, storage stability and image sharpness are excellent, and in which portions developed take on pure black in color. These leuco dyes and developers can be encapsulated in microcapsules for use.

In the present invention, as a roll of the binder resin used for forming a reversible thermosensitive recording layer along with the above-mentioned leuco dye and developer, it is to maintain a state of which various materials contained in the composition for reversible thermosensitive recording medium are uniformly dispersed by application of heat at the time of recording/erasing of image, without being unevenly dispersed, and thus it is preferable to use a crosslinked resin having high-heat resistance. In the present invention, as a resin component, a combination of a polyol resin having a hydroxyl value within the range of 100 KOHmg/g to 250 KOHmg/g and a crosslinkable component therewith is used. For the polyol resin, it is possible to use an acrylic polyol that can be obtained by random copolymerization, block copolymerization etc. of an acryl monomer, like acrylic monomers including acrylic polyol, methacrylic polyol, and like polyester polyol, polyurethane polyol, polyether polyol, polycaprolacton polyol, polycarbonate polyol, polyolefin polyol, polyvinyl butyral, cellulose acetate propionate, cellulose acetate butylate, soybean polyols as plastics derived from biomass, which have been a focus of constant attention. Of these, acrylic polyol, polyurethane polyol, and polycaprolacton polyol are preferable; and acrylic polyol is particularly preferable. To make these components crosslinked, an isocyanate crosslinker having a plurality of isocyanate groups is additionally used.

There are differences in properties of acrylic polyol resins depending on the difference in structure thereof. As a monomer having a hydroxyl group, hydroxyethyl acrylate (HEA), hydroxypropyl acrylate (HPA), 2-hydroxyethyl methacrylate (HEMA), 2-hydroxypropyl methacrylate (HPMA), 2-hydroxybutyl monoacrylate (2-HBA), 1,4-hydroxybutyl monoacrylate (1-HBA) or the like is used, and in particular, the use of a monomer having a primary hydroxyl group makes it possible to improve cracking resistance and durability is of a coated film, and thus 2-hydroxyethyl methacrylate is preferably used.

A polyol used in the present invention has a hydroxyl value of 100 KOHmg/g to 250 KOHmg/g. When the hydroxyl value is lower than 100, the rigidity of the crosslinked film becomes poor, and evaluation results of repetitive durability show that films formed using a polyol having a hydroxyl value of lower than 100 are likely to fracture. In contrast, when a polyol having a hydroxyl value of higher than 250 is used, it is unfavorable because a film cannot be completely crosslinked, and uncrosslinked components adversely affect color-developing components. Still more desirably, the hydroxyl value of the polyol be within the range of 150 to 220. Whether or not it is a reversible thermosensitive recording material obtained using a resin having a hydroxyl value within this range can be confirmed by quantifying the residues of hydroxyl group and/or the amount of ether bond.

Examples of curing agents (hardeners) used in the present invention include conventionally known isocyanates, amines, phenols, and epoxy compounds. Of these, isocyanate curing agents are preferably used. Examples of polyisocyanates include tolylene dilsocyanate, xylylene diisocyanate, isophorone diisocyanate, hydrogenated xylylene diusocyanate, dicyclohexylmethane dilsocyanate, norbornene diisocyanate, diphenylmethane diisocyanate, hexamethylene diisocyanate; adducts obtained between any of these isocyanates and a polyhydric alcohol compound such as trimethylol propane, and neopentyl glycol; allophanate-modified compounds, isocyanurate-modified compounds, burette-modified compounds and carbodiimide-modified compounds thereof, and blocked isocyanates. However, curing agents used in the present invention are not limited to the compounds described above. These compounds may be used alone or may be combined with the above-mentioned polyol resin.

Further, as a crosslinking promoter, a catalyst used in crosslinking reactions may be used. As the crosslinking promoter, tertiary amines such as 1,4-diaza-bicyclo[2,2,2]octane, and metal compounds such as organic tin compounds are exemplified. The entire amount of a curding agent added may be crosslinked or a partial amount thereof may be crosslinked. In other words, unreacted parts of hardener may be present. Since crosslinking reaction of this type is promoted with a lapse of time, the presence of unreacted parts of hardener does not represent that a crosslinking reaction is not promoted at all. Even when unreacted parts of hardener are detected, it does not mean that resin components in a crosslinked state are not present. Whether a polymer used in the present invention is in an uncrosslinked state or not can be distinguished by soaking a film formed using the polymer in a solvent having high solubility. In other words, a polymer in an uncrosslinked state melts into a solvent and does not remain in the solute, and therefore it is advisable to determine the presence or absence of polymer structures in the solute. The acrylic polyol resin used in the present invention can be obtained by using a mixture of a plurality of monomers selected from monomer components such as methyl methacrylate, styrene, n-butyl-methacrylate, and 2-ethylhexyl methacrylate, and monomer components having a hydroxyl group(s) such as (2-hydroxy)-ethyl methacrylate, and 4-hydroxybutyl acrylate as a base, adding other components such as acrylic acids when necessary, mixing the components with a catalyst suitably selected and copolymerizing the mixed components.

Besides the above mentioned, as binder resins, for example, polyvinyl chloride, polyvinyl acetate, vinyl chloride-vinyl acetate copolymers, ethyl cellulose, polystyrene, styrene copolymers, phenoxy resins, polyester, aromatic polyester, polyurethane, polycarbonate, polyacrylate ester, polymethacrylate ester, acrylic acid copolymers, maleic acid copolymers, polyvinyl alcohols, modified polyvinyl alcohols, hydroxyethyl cellulose, carboxymethyl cellulose, and starches may be mixed for use. Thermally crosslinkable components and photocrosslinkable components may be added thereto. Further, for the purpose of controlling properties of a hardened film, low-molecular weight diol compounds such as ethylene glycol, and glycerin can be mixed therewith.

With respect to drying and hardening (curing) of a reversible thermosensitive recording layer, after applying a reversible thermosensitive recording layer coating solution onto a base or a work piece and drying the applied solution, the applied solution is hardened (cured) in accordance with the necessity. The applied solution may be heated at a relatively high-temperature in a short period of time using a thermostatic bath or the like or may be heated at a relatively lowtemperature for long hours. As specific conditions for crosslinking reaction, it is desirable to heat a surface of a thermosensitive recording layer to be reacted under a temperature condition of about 30° C. to 130° C. for 1 minute to 150 hours or so. It is more desirable to heat the surface under a temperature condition of 40° C. to 100° C. for 2 minutes to 120 hours or so. Since importance is placed on productivity in manufacture, it is difficult to spend time until a crosslinking reaction is sufficiently completed. Therefore, separately from drying process, a crosslinking step may be provided. As conditions used in the crosslinking step, it is preferable that the surface to be reacted be heated at 40° C. to 100° C. for 2 minutes to 120 hours or so.

The film thickness of the reversible thermosensitive recording layer is preferably within the range of 1 μm to 20 μm, and more preferably within the range of 3 μm to 15 μm.

Further, in a reversible thermosensitive recording layer of the present invention, conventionally known additives may be added in accordance with the necessity for the purpose of improving coating property of the reversible thermosensitive recording layer. Examples of the additives include surfactants, conducting agents, fillers, antioxidants, photo-stabilizers, and color-image stabilizers.

In the present invention, the ratio of resins to color-developing components added in a reversible thermosensitive recording layer is preferably 0.1 to 10 relative to 1 of the color-developing components. When the ratio of the resins added is lower than 0.1, the heat strength of the reversible thermosensitive recording layer becomes insufficient, and when the ratio is higher than 10, the color-developed density is reduced, leading to a problem.

Further, it was found that by using a developer having the above-mentioned features in combination with a compound having a divalent group including at least one N atom or O atom in a molecule as a color erasure promoter, intermolecular interaction is induced between the color erasure promoter and the developer in the course of forming a colorless state, and the color erasure rate is remarkably quickened.

As a color erasure promoter used in the present invention, compounds having in their molecules an amide group (—NHCO—), a secondary amide group(>NCO—), a urethane group(—NHCOO—), a urea group (—NHCONH—), a ketone group (—CO—), diacylhydrazide group (—CONHNHCO—), a sulfone group (—$SO_2$—) and the like are preferable. Of these compounds, compounds having an amide group, a secondary amide group and a urethane group are particularly preferable. For example, as the compounds having an amide group and a urethane group, compounds represented by any one of the following General Formulas (2) to (9) are exemplified.

TABLE 1

| | |
|---|---|
| $R^3$—NHCO—$R^4$ | General Formula (2) |
| $R^3$—NHCO—$R^5$—CONH—$R^4$ | General Formula (3) |
| $R^3$—CONH—$R^5$—NHCO—$R^4$ | General Formula (4) |
| $R^3$—NHCOO—$R^4$ | General Formula (5) |
| $R^3$—NHCOO—$R^5$—OCONH—$R^4$ | General Formula (6) |
| $R^3$—OCONH—$R^5$—NHCOO—$R^4$ | General Formula (7) |

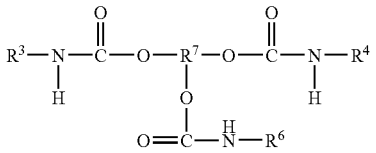

General Formula (8)

TABLE 1-continued

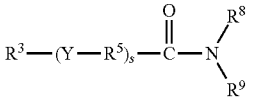

General Formula (9)

(in General Formulas (2) to (9), $R^3$, $R^4$, $R^6$, $R^8$ and $R^9$ respectively represent any one of a straight chain alkyl group having 1 to 22 carbon atoms, a branched alkyl group, and an unsaturated alkyl group; $R^8$ and $R^9$ may form a ring, and the ring may be formed via an N atom, an O atom or an S atom, and may have an aromatic ring or an aliphatic ring; each of the alkyl groups may have a halogen atom and/or a substituent such as an alkoxy group; $R^5$ represents a divalent functional group having 1 to 18 carbon atoms; $R^7$ represents a tertiary functional group having 4 to 18 carbon atoms; Y represents a divalent group containing an N atom or an O atom; and S is an integer of 0 or 1.)

Preferred examples of $R^3$, $R^4$, $R^6$, $R^8$ and $R^9$ are hexyl group, heptyl group, octyl group, nonyl group, decyl group, undecyl group, dodecyl group, stearyl group, behenyl group, oleyl group, and hydroxylalkyl group having a hydroxyl group at terminal ends thereof and having 1 to 10 carbon atoms. Preferred other examples of $R^8$ and $R^9$ are methyl group, ethyl group, benzyl group, phenylethyl group, cyclohexylmethyl group, and hydroxyethyl group; and when any one of $R^8$ and $R^9$ forms a ring structure, preferred examples of $R^8$ and $R^9$ are butylene group, pentamethylene group, hexamethylene group, —$C_2H_4OC_2H_4$— group, —$C_2H_4NC_2H_4$— group, and —$C_2H_4OC_2H_4OC_2H_4$— group. Preferred examples of $R^5$ are methylene group, ethylene group, propylene group, butylene group, pentamethylene group, hexamethylene group, heptamethylene group, octamethylene group, —$C_3H_6OC_3H_6$— group, —$C_2H_4OC_2H_4$— group, and —$C_2H_4OC_2H_4OC_2H_4$— group. Further, preferred examples of $R^7$, the following compounds are exemplified.

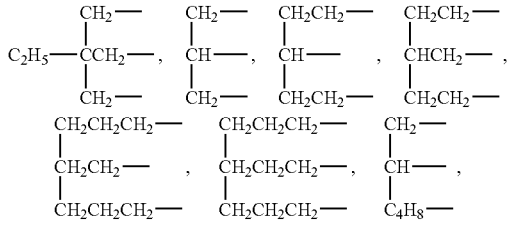

Preferred examples of Y are amide group, urethane group, urea group, ketone group, and diacylhydrazide group. However, compounds and groups used in the present invention are not limited to those mentioned above.

Specific examples of compounds represented by any one of General Formulas (2) to (9) are as follows:

$C_{11}H_{23}CONHC_{12}H_{25}$, $C_{15}H_{31}CONHC_{16}H_{33}$, $C_{17}H_{35}CONHC_{18}H_{37}$, $C_{17}H_{35}CONHC_{18}H_{35}$, $C_{21}H_{41}CONHC_{18}H_{37}$, $C_{15}H_{31}CONHC_{18}H_{37}$, $C_{17}H_{35}CONHCH_2HNOCC_{17}H_{35}$, $C_{11}H_{23}CONHCH_2HNOCC_{11}H_{23}$, $C_7H_{15}CONHC_2H_4HNOCC_{17}H_{35}$, $C_9H_{19}CONHC_2H_4HNOCC_9H_{19}$, $C_{11}H_{23}CONHC_2H_4HNOCC_{11}H_{23}$, $C_{17}H_{35}CONHC_2H_4HNOCC_{17}H_{35}$, $(CH_3)_2CHC_{14}H_{35}CONHC_2H_4HNOCC_{14}H_{35}(CH_3)_2$, $C_{21}H_{43}CONHC_2H_4HNOCC_{21}H_{43}$, $C_{17}H_{35}CONHC_6H_{12}HNOCC_{17}H_{35}$, $C_{21}H_{43}CONHC_6H_{12}HNOCC_{21}H_{43}$,
$C_{17}H_{33}CONHCH_2HNOCC_{17}H_{33}$,
$C_{17}H_{33}CONHC_2H_4HNOCC_{17}H_{33}$,
$C_{21}H_{41}CONHC_2H_4HNOCC_{21}H_{41}$,
$C_{17}H_{33}CONHC_6H_{12}HNOCC_{17}H_{33}$,
$C_8H_{17}NHCOC_2H_4CONHC_{18}H_{37}$,
$C_{10}H_{21}NHCOC_2H_4CONHC_{10}H_{21}$,
$C_{12}H_{25}NHCOC_2H_4CONHC_{12}H_{25}$,
$C_{18}H_{37}NHCOC_2H_4CONHC_{18}H_{37}$,
$C_{21}H_{43}NHOCC_2H_4CONHC_{21}H_{43}$,
$C_{18}H_{37}NHOCC_6H_{12}CONHC_{18}H_{37}$,
$C_{18}H_{35}NHCOC_4H_8CONHC_{18}H_{35}$,
$C_{18}H_{35}NHCOC_8H_{16}CONHC_{18}H_{35}$,
$C_{12}H_{25}OCONHC_{18}H_{37}$, $C_{13}H_{27}OCONHC_{18}H_{37}$,
$C_{16}H_{33}OCONHC_{18}H_{37}$, $C_{18}H_{37}OCONHC_{18}H_{37}$,
$C_{21}H_{43}OCONHC_{18}H_{37}$, $C_{12}H_{25}OCONHC_{16}H_{33}$,
$C_{13}H_{27}OCONHC_{16}H_{33}$, $C_{16}H_{33}OCONHC_{16}H_{33}$,
$C_{18}H_{37}OCONHC_{16}H_{33}$, $C_{21}H_{43}OCONHC_{16}H_{33}$,
$C_{12}H_{25}OCONHC_{14}H_{29}$, $C_{13}H_{27}OCONHC_{14}H_{29}$,
$C_{16}H_{33}OCONHC_{14}H_{29}$, $C_{18}H_{37}OCONHC_{14}H_{29}$,
$C_{22}H_{45}OCONHC_{14}H_{29}$, $C_{12}H_{25}OCONHC_{12}H_{37}$,
$C_{13}H_{27}OCONHC_{12}H_{37}$, $C_{16}H_{33}OCONHC_{12}H_{37}$,
$C_{18}H_{37}OCONHC_{12}H_{37}$, $C_{21}H_{43}OCONHC_{12}H_{37}$,
$C_{22}H_{45}OCONHC_{18}H_{37}$,
$C_{18}H_{37}NHCOOC_2H_4OCONHC_{18}H_{37}$,
$C_{18}H_{37}NHCOOC_3H_6OCONHC_{18}H_{37}$,
$C_{18}H_{37}NHCOOC_4H_8OCONHC_{18}H_{37}$,
$C_{18}H_{37}NHCOOC_6H_{12}OCONHC_{18}H_{37}$,
$C_{18}H_{37}NHCOOC_8H_{16}OCONHC_{18}H_{37}$,
$C_{18}H_{37}NHCOOC_2H_4OC_2H_4OCONHC_{18}H_{37}$,
$C_{18}H_{37}NHCOOC_3H_6OC_3H_6OCONHC_{18}H_{37}$,
$C_{18}H_{37}NHCOOC_{12}H_{24}OCONHC_{18}H_{37}$,
$C_{18}H_{37}NHCOOC_2H_4OC_2H_4OC_2H_4OCONHC_{18}H_{37}$,
$C_{16}H_{33}NHCOOC_2H_4OCONHC_{16}H_{33}$,
$C_{16}H_{33}NHCOOC_3H_6OCONHC_{16}H_{33}$,
$C_{16}H_{33}NHCOOC_4H_8OCONHC_{16}H_{33}$,
$C_{16}H_{33}NHCOOC_6H_{12}OCONHC_{16}H_{33}$,
$C_{16}H_{33}NHCOOC_8H_{16}OCONHC_{16}H_{33}$,
$C_{18}H_{37}OCOHNC_6H_{12}NHCOOC_{18}H_{37}$,
$C_{16}H_{33}OCOHNC_6H_{12}NHCOOC_{16}H_{33}$,
$C_{14}H_{29}OCOHNC_6H_{12}NHCOOC_{14}H_{29}$,
$C_{12}H_{25}OCOHNC_6H_{12}NHCOOC_{12}H_{25}$,
$C_{10}H_{21}OCOHNC_6H_{12}NHCOOC_{10}H_{21}$ and
$C_8H_{17}OCOHNC_6H_{12}NHCOOC_8H_{17}$.

TABLE 2

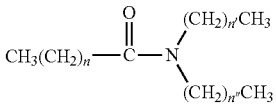

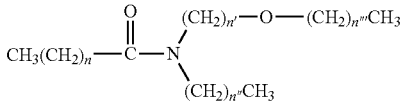

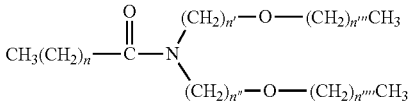

TABLE 2-continued

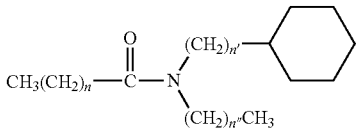

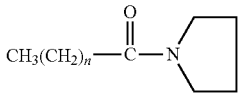

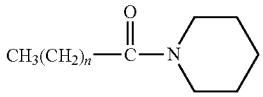

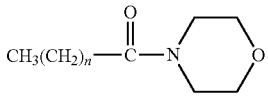

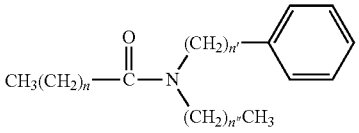

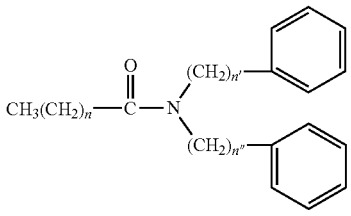

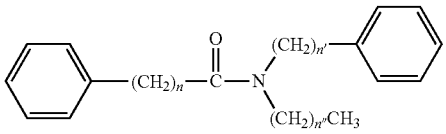

TABLE 3

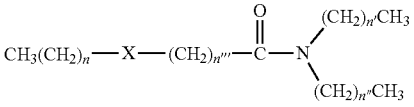

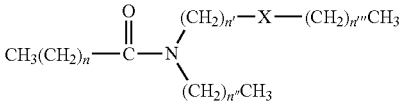

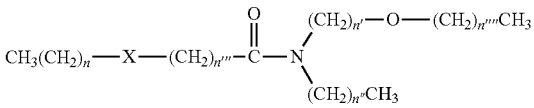

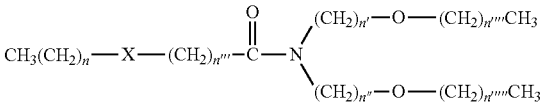

TABLE 3-continued

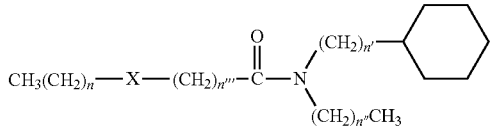

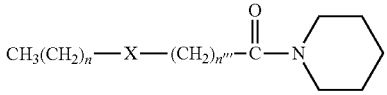

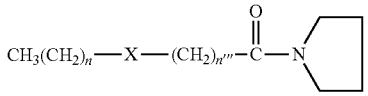

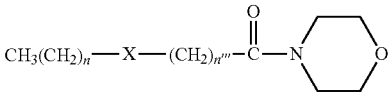

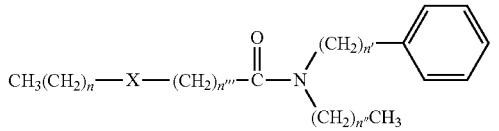

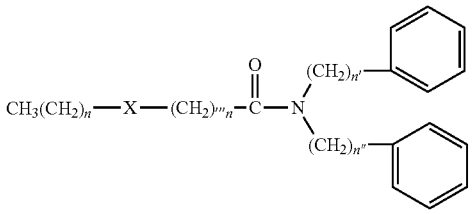

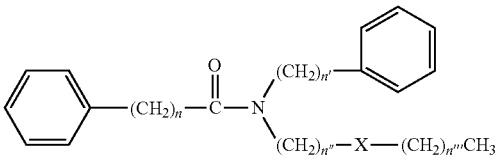

TABLE 4

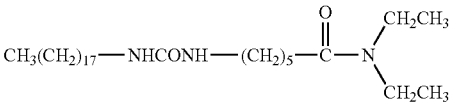

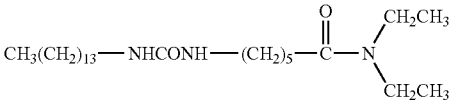

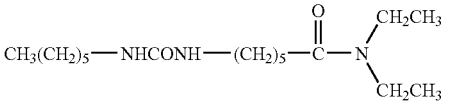

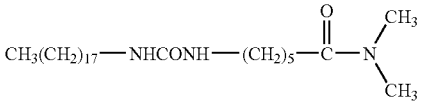

TABLE 4-continued

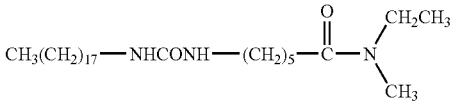

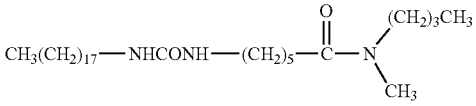

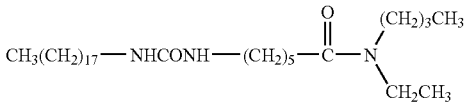

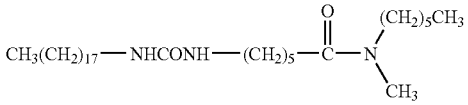

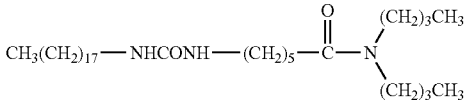

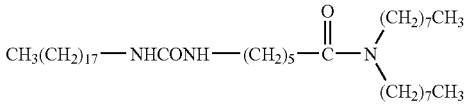

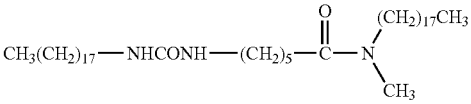

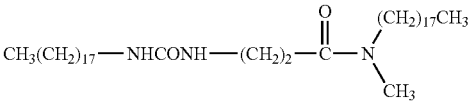

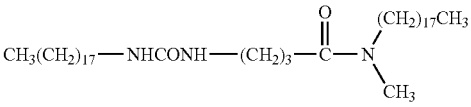

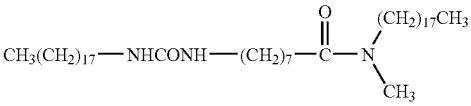

In Table 4, n, n', n'', n''', and n'''' are respectively an integer of 0 to 21. However, all of them cannot be an integer of 5 or lower.

Further, according to the present invention, it is possible to provide on a reversible thermosensitive recording layer a protective layer containing a resin in a crosslinked state. For the resin used for the protective layer, the thermally curable resin and/or conventionally known ultraviolet curable resin and electron beam curable resin can be used. Further, in the present invention, the protective layer may contain conventionally known inorganic/organic fillers, lubricants, and ultraviolet ray absorbing materials. In the formation of a protective layer, the protective layer preferably has a thickness within the range of 0.1 μm to 20 μm, and more preferably has a thickness within the range of 0.3 μm to 10 μm. For a solvent used for a protective layer coating solution, a dispersing device, a binder, a coating method, and drying/curing method etc. used for application of the protective layer coating solution, it is possible to use conventionally known materials and methods used in forming the reversible thermosensitive recording layer.

Further, an intermediate layer (first protective layer) may be provided between the reversible thermosensitive recording layer and the protective layer for the purpose of improving adhesiveness of the protective layer, preventing deterioration of the reversible thermosensitive recording layer that could be caused by application of the protective layer, preventing additives contained in the protective layer from transferring into the reversible thermosensitive recording layer or preventing additives contained in the reversible thermosensitive recording layer from transferring into the protective layer. The intermediate layer preferably has a thickness within the range of 0.1 μm to 20 μm, and more preferably has a thickness within the range of 0.3 μm to 10 μm. For a solvent used for an intermediate layer coating solution, a dispersing device, a binder, a coating method, and drying/curing method etc. used for application of the intermediate layer coating solution, conventionally known materials and methods used in forming the reversible thermosensitive recording layer can be used. Further, in the present invention, the intermediate layer may contain conventionally known inorganic/organic fillers, lubricants, and ultraviolet ray absorbing materials.

A support of the reversible thermosensitive recording medium of the present invention is any one of paper, a resin film, a PET film, synthetic paper, a metal foil, glass or a composite thereof, and the support may be selected therefrom, as long as capable of supporting a reversible thermosensitive recording layer. Further, a support having a necessary thickness may be used alone, and a plurality of supports which are laminated onto each other may be used. Specifically, it is possible to use a support having an arbitrarily determined thickness within the range of from several micrometers to several millimeters, and within the preferred range of from 60 μm to 150 μm.

Further, in the present invention, in order to improve color-developing sensitivity by efficiently utilizing heat applied to a recording medium at the time of recording, a heat insulating layer can be provided between the support and the reversible thermosensitive recording layer. The heat insulating layer can be formed by applying a coating solution containing a binder resin containing organic or inorganic hollow fine particles onto the reversible thermosensitive recording layer. In the heat insulating layer, resins similarly to those used in the reversible thermosensitive recording layer, the intermediate layer, and the protective layer can be used. Further, in the heat insulating layer, inorganic fillers such as calcium carbonate, magnesium carbonate, titanium oxide, silicon oxide, aluminium hydroxide, kaolin, and talc and/or various organic fillers can be added. Besides, a surfactant(s), and a dispersing agent(s) can be added therein.

In the case where the heat insulating layer is provided, by proving the heat insulating layer onto the support via an adhesive layer (tacky layer), it is possible to prevent the occurrence of cracks and burr.

The adhesive layer (tacky layer) can be formed by a similar method to those used for each of the above-mentioned layers.

In a reversible thermosensitive recording label of the present invention, an adhesive layer (tacky layer) is provided on a surface of a support constituting the reversible thermosensitive recording medium, which is opposed to a surface on which a reversible thermosensitive recording layer is provided.

This type of reversible thermosensitive recording label is categorized into the following two types: one type is a reversible thermosensitive recording label in which an adhesive layer (tacky layer) is formed (non-peelable type), and the other type is a reversible thermosensitive recording layer in which a release paper is affixed under the adhesive layer (tacky layer) (release paper type). As a material constituting the adhesive layer (tacky layer), a hot-melt type material is commonly used.

The adhesive layer is a layer formed of an adhesive agent, and the tacky layer is a layer formed of a tackiness agent. Adhesive agents and tackiness agents share the same function: Both agents bond two articles or substrates together. As used herein, adhesive agents refer to those agents that, when applied, conform to articles in a relatively soft state, but undergo state changes for hardening with time or by means of heating or cooling and firmly bond to both of the articles. On the other hand, tackiness agents refer to those adhesive agents which are soft semisolids which do not essentially undergo state changes.

A material of the adhesive layer (tacky layer) can be selected from commonly used materials for them.

Examples of the materials used for adhesive layer (tacky layer) include urea resins, melamine resins, phenol resins, epoxy resins, vinyl acetate resins, vinyl acetate-acrylate copolymers, ethylene-vinyl acetate copolymers, acrylate resins, polyvinyl ether resins, vinyl chloride-vinyl acetate copolymers, polystyrene resins, polyester resins, polyurethane resins, polyamide resins, chlorinated polyolefin resins, polyvinylbutyral resins, acrylic ester copolymers, methacrylic ester copolymers, natural rubber, cyanoacrylate resins, and silicon resins. However, the materials are not limited thereto.

The reversible thermosensitive recording medium of the present invention, at least the reversible thermosensitive recording layer constituting the reversible thermosensitive recording medium serves as a reversible display section, and can be used as an information display/storage member which is produced using the reversible thermosensitive recording medium along with a member having an information storage function (information storage section).

Hereinafter, the information display/storage member will be described.

This member having an information storage section and a reversible display section can be broadly categorized into the following three types:

(1) Part of a member having an information storage function is used as a support of a reversible thermosensitive recording medium, and a reversible thermosensitive layer is directly formed on the support.

(2) A reversible thermosensitive recording medium having a reversible thermosensitive recording layer on a support is prepared, and then a surface of the recording medium with the support provided is bonded to a surface of a member having an information storage function.

(3) To a member having an information storage function, the reversible thermosensitive recording label is bonded via an adhesive layer (tacky layer).

In these members (1), (2), and (3), it is necessary to set the information storage section and the reversible display section so that the respective functions can be exhibited. The setting positions of the information storage section and the reversible display section may be arbitrarily selected in accordance with the intended use, provided that the above condition can be satisfied. Specifically, the member having an information storage section and a reversible display section can be placed on a surface of a support of a reversible thermosensitive recording medium, which is opposed to a surface on which a reversible thermosensitive layer is provided, can be disposed in between the support and the thermosensitive layer, or on part of the thermosensitive layer.

The member having an information storage function is not particularly limited, and a generally used card, disc, disk cartridge or tape cassette can be used.

Examples of the member having an information storage function include thick cards such as IC card, and optical card; flexible cards; disk cartridges incorporating a disc in which stored information is rewritable such as optical magnetic recording discs (MD) and DVD-RAM; discs using no disk cartridge, such as CD-RW; recordable discs such as CD-R; optical information recording media using a phase-change memory material (CD-RW); and video tape cassettes.

The information display/storage member having both a reversible display function and an information storage function will be described below with a case of a card, for example. A user owns a card having both of the functions can confirm information by only looking contents displayed in the card with no use of a special device, and the convenience or user-friendliness of the card is much superior to those of cards using no reversible thermosensitive recording medium.

The information storage section is not particularly limited as long as it can store necessary information. For instance, magnetic recording material, contact type IC, non-contact type IC or optical memory is usable.

A magnetic recording layer can be formed by using a commonly used metal compound like iron oxide or barium ferrite, and a resin such as a vinyl chloride resin, urethane resin or nylon resin and applying a coating solution containing these components onto a support; or by using the metal compound by evaporation or sputtering, without using resins. Further, a reversible thermosensitive recording layer used for display in a reversible thermosensitive recording medium can be also used as a storage section in the manner of bar code, two-dimensional bar code or the like.

As specific instances of use of the reversible thermosensitive recording label (3), in the case of a thick support on which application of a reversible thermosensitive recording layer is difficult to achieve, like a magnetic stripe card made of vinyl chloride etc., an adhesive layer (tacky layer) can be provided on the entire surface or part of the surface of the reversible thermosensitive recording label.

By doing so, part of information stored in the magnetic can be displayed, and the convenience or user-friendliness of this recording medium can be enhanced.

As a reversible thermosensitive recording label with an adhesive layer (tacky layer) formed on a surface thereof can be used in not only the magnetic vinyl chloride card but also in thick cards such as IC card and optical card.

Furthermore, the reversible thermosensitive recording label can be used in place of a display label affixed on a flexible disk, or affixed on a disk cartridge incorporating a disc in which stored information is rewritable, such as MD and DVD-RAM.

Further, in the case where a disc using no disk cartridge, such as CD-RW, the reversible thermosensitive recording label can be directly affixed to the disc, and a reversible thermosensitive recording layer can be directly provided on the disc as well. By doing so, application of use of such a disc can be expanded, such as contents displayed are automatically changed in accordance with a change in contents stored therein.

The reversible thermosensitive recording label of the present invention also allows for rewriting part of stored information which has been additionally recorded in a recordable disc (CD-R), and displaying the content by affixing the reversible thermosensitive recording label onto the CD-R.

The reversible thermosensitive recording label can be used as a display label for video tape cassette.

As a method of providing a thermally reversible recording function onto a thick card, a disk cartridge, or a disc, besides the method of affixing a reversible thermosensitive recording label, there are, for example, the following methods: a method in which a reversible thermosensitive recording layer is directly applied thereonto; a method in which a reversible thermosensitive recording layer is previously formed on a different support, and then the thermosensitive recording layer is printed on a thick card, a disk cartridge, or a disc.

When a reversible thermosensitive recording layer is printed on a thick card, a disk cartridge, or a disc, an adhesive layer (tacky layer) of hot-melt type may be formed on the eversible thermosensitive recording layer.

When a reversible thermosensitive recording label is affixed onto, or a reversible thermosensitive recording layer is provided on a rigid or inflexible product such as a thick card, disc, disk cartridge, and tape cassette, it is preferable that a layer or a sheet that is capable of improving the contactability with thermally heads, and is elastic so as to be a cushion for forming images with a uniform density be provided between a rigid base and the label or the reversible thermosensitive recording layer.

Figure 2:
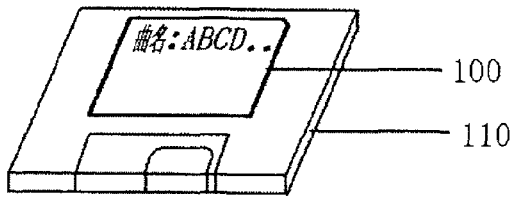
FIG. 2 is a view showing an example where a reversible thermosensitive recording label of the present invention is affixed onto an MD disk cartridge.
Figure 3:
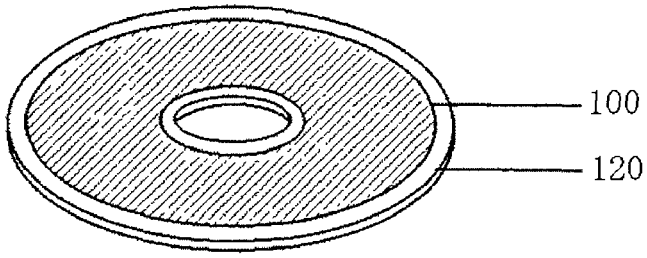
FIG. 3 is a view showing an example where a reversible thermosensitive recording label is affixed onto a CD-RW.
Figure 4:
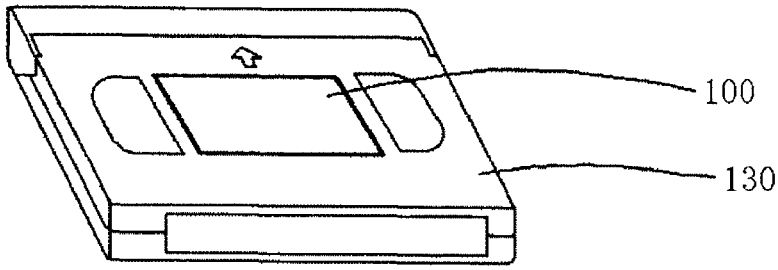
FIG. 4 is a view showing an example where a reversible thermosensitive recording medium of the present invention is used as a label of a video tape cassette.

FIG. 2 shows an MD disk cartridge 11 having a thermally reversible recording label 100; FIG. 3 shows a CD-RW 120 having a thermally reversible recording label 100; and FIG. 4 shows a video cassette 130 having a thermally reversible recording label 100.

The present invention further provides an image processing method in which an image is formed and/or erased by applying heat to the reversible thermosensitive recording medium, the member having an information storage section, or the reversible thermosensitive recording label.

In the formation of an image, an image recording unit which is capable of imagewise heating part of the recording medium, such as thermal head, and laser, is used. In the erasure of the formed image, an image erasing unit, such as hot stamp, ceramic heater, heat roller, hot air, thermal head, and laser, is used.

Among these, a ceramic heater is preferably used. The use of a ceramic heater makes it possible to downsize the device used and obtain a stable erased state and a high-contrast image.

The setting temperature of the ceramic heater is preferably 90° C. or higher, and more preferably 100° C. or higher.

The use of a thermal head as an image erasing unit makes it possible to further downsize the device and reduce electrical power consumption. In addition, it makes it possible to use a battery-driven handy type device. With the use of one thermal head which is usable in the formation of images and the erasure thereof, a further downsized device can be achieved.

When an image is formed and erased using one thermal head, images formed previously may be completely erased, and then a new image may be formed. Alternatively, an overwriting mode is possible, in which images formed previously may be erased by varying the energy per image, and then a new image may be formed.

In the overwrite mode, it takes a short period of time to form an image and erase the formed image, i.e., only a short time is required for a combined time for image formation and image erasure, which leads to higher speed recording. When a card having a reversible thermosensitive recording layer and an information storage section is used, the above-mentioned device includes a reading unit configured to read information stored in the information storage section as well as a rewriting unit.

Figure 5:
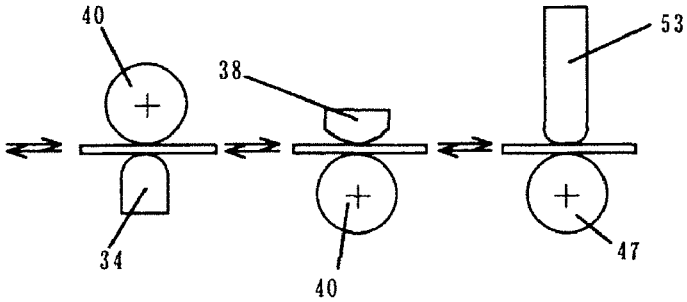
FIG. 5 is a view showing an example of an image processor according to the present invention.

The image processing method of the present invention is carried out through the use, for example, of an image processor as shown in FIG. 5, which is equipped with a magnetic head 34 and a conveyance roller 40 facing each other; a ceramic heater 38 and another conveyance roller 40 facing each other; and a conveyance roller 47 and a thermal head 53 facing each other.

EXAMPLES

The present invention will be further described in detail with reference to Examples and Comparative Examples, however, the present invention is not limited to the following Examples. On the contrary, the present invention is intended to cover various modifications and equivalent arrangements included within the spirit and scope of the appended claims. It should be noted that the units represented by "part", "parts", and "%" below are construed on the basis of "mass", namely, as "part by mass", "parts by mass", or "% by mass", unless otherwise noted.

Example 1

<Preparation of Reversible Thermosensitive Recording Layer>

| | |
|---|---|
| developer having the following structure (melting point: 145° C.) | 4 parts |

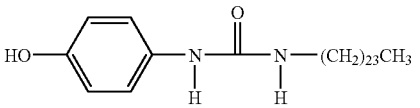

| | |
|---|---|
| octadecanoic pentadecylamide | 0.5 parts |
| ethyl acetate solution containing 40% of acrylic polyol resin (hydroxyl value: 108, acid value: 4.2, molecular weight: 55,000) | 7 parts |
| methylethylketone (MEK) | 70 parts |

The composition described above was pulverized and dispersed using a ball mill until the average particle diameter became about 1 μm, and a dispersion liquid was thus prepared. Into the obtained dispersion liquid, 1 part of 2-anilino-3-methyl-6-dibutylaminofluoran, and 4 parts of an ethyl acetate diluent, in which TAKENATE D-110N manufactured by Mitsui Takeda Chemicals (ethyl acetate solution containing 75% of adduct type xylylene diusocyanate) was diluted 40% with MEK, were added and sufficiently stirred to thereby prepared a reversible thermosensitive recording layer coating solution. The reversible thermosensitive recording layer coating solution having the composition was applied onto a white-color PET film having a thickness of 250 μm using a wire bar, applied coating solution was dried at 110° C. for 3 minutes, and then heated at 60° C. for 24 hours, thereby a reversible thermosensitive recording layer having a film thickness of about 11 μm was formed on the PET film.

Further, onto the recording layer, an intermediate layer coating solution having the following composition was applied using a wire bar, the applied coating solution was dried at 90° C. for 1 minute, and then heated at 60° C. for 2 hours to thereby provide an intermediate layer having a film thickness of about 1 μm.

Further, onto the intermediate layer, a protective layer coating solution having the following composition was applied using a wire bar, and the PET film with the intermediate coating solution applied to the surface thereof was passed under an ultraviolet lamp with an irradiation energy of 80 W/cm at a conveyance speed of 12 m/min and cured to form a protective layer having a film thickness of 5 μm, thereby preparing a reversible thermosensitive recording medium according to the present invention.

| | |
|---|---|
| [Intermediate layer coating solution] | |
| MEK solution containing 10% of polyester polyol resin (TAKELACK U-21 available from Takeda Pharmaceutical Co., Ltd.) | 100 parts |
| zinc oxide (available from Sumitomo Osaka Cement Co., Ltd.) | 10 parts |
| COLLONATE HL (available from Nippon Polyurethane Industry Co., Ltd.) | 15 parts |
| [Protective layer coating solution] | |
| urethane acrylate ultraviolet curable resin (C7-157 available from Dainippon Ink and Chemicals, Inc.) | 7 parts |
| dipentaerithritol caprolactone-modified acrylic ester (KAYARAD DPCA-120 available from Nippon Kayaku Co., Ltd.) | 3 parts |
| silica (P-527 available from MIZUSAWA INDUSTRIAL CHEMICALS, LTD.) | 1.5 parts |
| ethyl acetate | 90 parts |

Example 2

A reversible thermosensitive recording medium was prepared in a similar manner to those in Example 1, except that the acrylic polyol resin in the reversible thermosensitive recording layer was changed to 5.5 parts of an acrylic polyol having a hydroxyl value of 200 and an acid value of 4.7, and the use amount of the diluent of TAKENATE D-110N was changed from 2 parts to 5.5 parts.

Example 3

A reversible thermosensitive recording medium was prepared in a similar manner to those in Example 1, except that the acrylic polyol resin in the reversible thermosensitive recording layer was changed to 5 parts of an acrylic polyol having a hydroxyl value of 250 and an acid value of 4.0, and the use amount of the diluent of TAKENATE D-110N was changed from 2 parts to 6 parts.

Example 4

A reversible thermosensitive recording medium was prepared in a similar manner to those in Example 1, except that a compound represented by the following structural formula (melting point: 143° C.) was used as a developer.

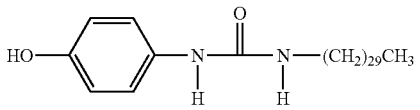

Example 5

A reversible thermosensitive recording medium was prepared in a similar manner to those in Example 1, except that the acrylic polyol resin in the reversible thermosensitive recording layer was changed to 6.5 parts of a solution containing 40% of a polycaprolactone polyol having a hydroxyl value of 135 (TONE0210 available from Dow Chemical Co., Ltd.), and the use amount of the diluent of TAKENATE D-110N was changed from 2 parts to 4.5 parts.

Comparative Example 1

A reversible thermosensitive recording medium was prepared in a similar manner to those in Example 1, except that the acrylic polyol resin in the reversible thermosensitive recording layer was changed to 8 parts of an acrylic polyol having a hydroxyl value of 80 and an acid value of 4.3, and the use amount of the diluent of TAKENATE D-110N was changed from 2 parts to 3 parts.

Comparative Example 2

A reversible thermosensitive recording medium was prepared in a similar manner to those in Example 1, except that the acrylic polyol resin in the reversible thermosensitive recording layer was changed to 4.5 parts of an acrylic polyol having a hydroxyl value of 300 and an acid value of 5.1, and the use amount of the diluent of TAKENATE D-110N was changed from 2 parts to 6.5 parts.

Comparative Example 3

A reversible thermosensitive recording medium was prepared in a similar manner to those in Example 1, except that a compound represented by the following structural formula (melting point: 145° C.) was used as a developer.

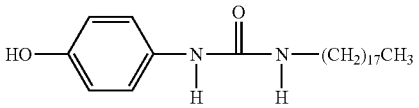

Comparative Example 4

A reversible thermosensitive recording medium was prepared in a similar manner to those in Example 1, except that a compound represented by the following structural formula (melting point: 140° C.) was used as a developer.

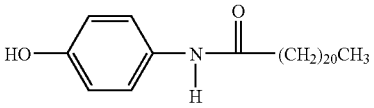

Comparative Example 5

A reversible thermosensitive recording medium was prepared in a similar manner to those in Example 1, except that a compound represented by the following structural formula (melting point: 141° C.) was used as a developer.

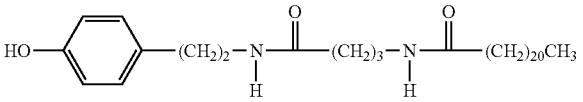

(Evaluation Method)

1. Image Density, Background Density, and Residual Density

On each of the prepared reversible thermosensitive recording media, an image was printed and erased under the following conditions using a thermosensitive printing simulator and an edge face type thermal head, KSB320AA (resistance value: 1,206 ohms) and a ceramic heater (4 mm in width) each manufactured by KYOCERA Corp. and the image density was measured by means of Macbeth densitometer, RD-914.

Evaluation conditions: 5 inches/s printing speed, 8 dot/mm vertical scanning density Image density: A maximum density measured immediately after an image was printed with varying voltage energy applied with single volt increments was used.

Erasure density: A minimum erasure density measured immediately after a solid image formed by application of the voltage energy with which the maximum density could be obtained in the measurement of image density was erased with varying the setting temperature of the ceramic heater with 5° C. increments was used.

2. Storage Stability

The solid image formed under the above-mentioned conditions was stored in a thermostatic bath of 20° C. for 100 hours, and the image density of the solid image after the storage was measured.

3. Durability

The same image was repeatedly erased and printed 200 times under the above-mentioned conditions, and a residual density measured immediately after erasing of a solid image portion was measured. Further, the appearance of the thermal head at that time was observed with the use of an optical microscope.

A: The resultant state of the thermal head was substantially same as that before the test was started.

B: Foreign matters were accumulated downstream of the flow passage of the thermal head.

C: Foreign matters were accumulated even at the heating unit.

Table 5 shows the evaluation results.

TABLE 5

| | Erasure property | | | Storage | Durability | | |
|---|---|---|---|---|---|---|---|
| | Image density | Background density | Erasure density | stability at 60° C. | Image density | Erasure density | Appearance of thermal head after test |
| Ex. 1 | 1.40 | 0.07 | 0.07 | 1.26 | 1.29 | 0.08 | A |
| Ex. 2 | 1.37 | 0.07 | 0.07 | 1.29 | 1.33 | 0.08 | A |
| Ex. 3 | 1.39 | 0.07 | 0.07 | 1.22 | 1.30 | 0.08 | A |

TABLE 5-continued

| | Erasure property | | | Storage | Durability | | |
|---|---|---|---|---|---|---|---|
| | Image density | Background density | Erasure density | stability at 60° C. | Image density | Erasure density | Appearance of thermal head after test |
| Ex. 4 | 1.39 | 0.07 | 0.07 | 1.33 | 1.28 | 0.08 | A |
| Ex. 5 | 1.42 | 0.08 | 0.08 | 1.25 | 1.25 | 0.09 | A |
| Compara. Ex. 1 | 1.40 | 0.07 | 0.07 | 1.02 | 1.19 | 0.08 | B |
| Compara. Ex. 2 | 1.36 | 0.07 | 0.07 | 1.18 | 0.90 | 0.13 | A |
| Compara. Ex. 3 | 1.42 | 0.07 | 0.07 | 0.36 | 0.76 | 0.08 | A |
| Compara. Ex. 4 | 1.39 | 0.07 | 0.10 | 0.65 | 1.09 | 0.13 | A |
| Compara. Ex. 5 | 1.35 | 0.07 | 0.07 | 1.23 | 1.13 | 0.15 | C |

What is claimed is:

1. A reversible thermosensitive recording medium comprising:

a support, and a reversible thermosensitive recording layer laid on the support, the recording layer containing a reversible thermosensitive composition, wherein the reversible thermosensitive composition forms a relatively color-developed state and a colorless state depending on a difference in a heating temperature and/or a cooling rate after heating by the use of an electron-donating color-forming compound and an electron-accepting compound; a resin component contained in the reversible thermosensitive recording layer is a resin in which a polyol resin having a hydroxyl value within the range of 100 KOHmg/g to 250 KOHmg/g is crosslinked; and as the electron-accepting compound, a urea compound represented by the following General Formula (1) is used, General Formula (1)

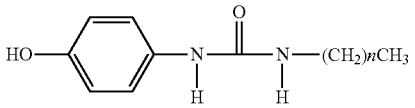

where "n" is an integer of 23 or greater.

2. A member having an information recording section, comprising:

an information storage section, and a reversible display section, wherein the reversible display section comprises at least a reversible thermosensitive recording medium, and the reversible thermosensitive recording medium comprises:

a support, and a reversible thermosensitive recording layer laid on the support, the recording layer containing a reversible thermosensitive composition, wherein the reversible thermosensitive composition forms a relatively color-developed state and a colorless state depending on a difference in a heating temperature and/or a cooling rate after heating by the use of an electron-donating color-forming compound and an electron-accepting compound; a resin component contained in the reversible thermosensitive recording layer is a resin in which a polyol resin having a hydroxyl value within the range of 100 KOHmg/g to 250 KOHmg/g is crosslinked; and as the electron-accepting compound, a urea compound represented by the following General Formula (1) is used, General Formula (1)

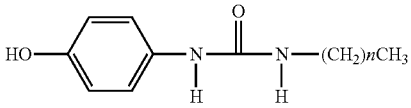

where "n" is an integer of 23 or greater.

3. The member according to claim 2, being any one of a card, a disc, a disk cartridge, and a tape cassette.

4. An image processing method comprising:

forming an image, and/or erasing the formed image by heating any one of reversible thermosensitive recording layers each of which constitutes any one of a reversible thermosensitive recording medium, a reversible thermosensitive recording label, and a member having an information storage section, wherein the reversible thermosensitive recording medium comprises a support, and a reversible thermosensitive recording layer laid on the support, the recording layer containing a reversible thermosensitive composition, the reversible thermosensitive composition forms a relatively color-developed state and a colorless state depending on a difference in a heating temperature and/or a cooling rate after heating by the use of an electron-donating color-forming compound and an electron-accepting compound, a resin component contained in the reversible thermosensitive recording layer is a resin in which a polyol resin having a hydroxyl value within the range of 100 KOHmg/g to 250 KOHmg/g is crosslinked, and as the electron-accepting compound, a urea compound represented by the following General Formula (1) is used, General Formula (1)

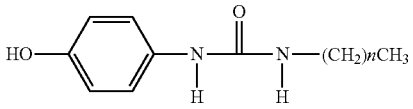

where "n" is an integer of 23 or greater;

wherein the reversible thermosensitive recording label comprises the reversible thermosensitive recording medium, and an adhesive layer (tacky layer) provided on a surface of the support of the reversible thermosensitive recording medium, which is opposed to a surface on which the reversible thermosensitive recording layer is provided; and wherein the member having an information storage section comprises an information storage section, and a reversible display section, and the reversible display section comprises at least the reversible thermosensitive recording medium.

5. The image processing method according to claim 4, wherein the image is formed using a thermal head.

6. The image processing method according to claim 4, wherein the formed image is erased using any one of a thermal head and a ceramic heater.

* * * * *